US009783336B2

(12) United States Patent
Liaou

(10) Patent No.: US 9,783,336 B2
(45) Date of Patent: Oct. 10, 2017

(54) CARTON STRUCTURE

(71) Applicant: Normandy Inc., San Bernardino, CA (US)

(72) Inventor: Gary Liaou, San Bernardino, CA (US)

(73) Assignee: Normandy Inc., San Bernardino, CA (US)

( * ) Notice: Subject to any disclaimer, the term of this patent is extended or adjusted under 35 U.S.C. 154(b) by 0 days.

(21) Appl. No.: 14/704,245

(22) Filed: May 5, 2015

(65) Prior Publication Data

US 2016/0297561 A1 Oct. 13, 2016

(30) Foreign Application Priority Data

Apr. 13, 2015 (TW) ..... 104205494 U

(51) Int. Cl.

| | |
|---|---|
| ***B65D 5/42*** | (2006.01) |
| ***B65D 5/468*** | (2006.01) |
| ***B65D 81/05*** | (2006.01) |
| ***B65D 5/44*** | (2006.01) |
| ***B65D 5/00*** | (2006.01) |

(52) U.S. Cl.

CPC ..... *B65D 5/4608* (2013.01); *B65D 5/006* (2013.01); *B65D 5/443* (2013.01); *B65D 5/445* (2013.01); *B65D 81/053* (2013.01)

(58) Field of Classification Search

CPC ..... B65D 5/445; B65D 5/006; B65D 5/443; B65D 5/5033; B65D 5/005; B65D 81/053

USPC ..... 229/918, 919, 195, 198.1, 198.2, 915, 229/186; 206/509, 586, 453, 503

See application file for complete search history.

(56) References Cited

U.S. PATENT DOCUMENTS

| | | | | |
|---|---|---|---|---|
| 3,341,106 | A * | 9/1967 | Seltman | B65D 5/445 229/199 |
| 3,368,736 | A * | 2/1968 | McKellick | B65D 5/445 229/199 |
| 3,957,196 | A * | 5/1976 | Kellerman | B65D 5/5033 206/326 |
| 2011/0180450 | A1* | 7/2011 | Hainer | B65B 11/045 206/586 |
| 2014/0069842 | A1* | 3/2014 | D'Anglade | B65D 81/054 206/586 |

* cited by examiner

*Primary Examiner* — Christopher Demeree

(74) *Attorney, Agent, or Firm* — C. G. Mersereau; Nikolai & Merserau, P.A.

(57) ABSTRACT

The present invention provides a carton structure, comprising: a confined body portion having four side wall portions formed by four rectangular boards, and bending portions formed between the side wall portions; a top cover at top of the confined body portion and configured to match therewith; a bottom cover at bottom of the confined body portion and configured to match therewith; wherein at least two supporting members attached onto surfaces of the bending portions; two upper and lower areas at outer surfaces of the side wall portions adjacent to the bending portions are formed of at least two openings and two folding portions correspondingly; the openings and the folding portions are connected to each other; and the folding portions can be pushed and bent toward outer surface of the supporting members in order to reach inner surface of the supporting members to be further secured onto the supporting members.

8 Claims, 2 Drawing Sheets

CARTON STRUCTURE

FIELD OF THE INVENTION

The present invention is related to a carton structure, in particular, to carton structure with supporting members.

BACKGROUND OF THE INVENTION

With the rapid development of the technology and the transportation in the recent years, it is becoming more common to transport a product manufactured at site A to site B for packaging and shipping. Therefore, the research and development on the environmental packaging materials have become crucial tasks in the industry. In view of such demand, large shipment of goods and products used to be packaged and transported with the traditional wooden boxes and plastic boxes have now been greatly replaced by cartons to lower costs. One of the main reasons of such trend in the increase use of cartons may be due to the drawbacks of the high cost and heavy weight of the wooden boxes and of the environmental and disposal issues associated with the plastic boxes. Accordingly, in contrast, carton boxes have a number of merits of being light in weight, pressure resistant function, low in manufacturing cost, endurable to uses, recyclable and other advantages.

However, the weight resistance and the toughness of the cartons are still unmatchable to the ones of the wooden boxes and plastic boxes; particularly, for the bending portions at the side walls of the four lateral sides of the carton box, during the transportation process of an overweight packaged article carried or accidental impacts by rigid foreign objects during the transportation, the side wall bending portions at the four lateral sides of the carton are prone to damages and indentations, which may result in the destruction of the carton itself such that the packaged article may be exposed to the outer of the carton or even fall out of the carton.

In view of the aforementioned shortcomings of the prior arts, the inventor the present invention provides a carton structure having a plurality of supporting structure members attached to surfaces of the bending portions of the carton structure respectively, and two upper and lower areas of the carton structure adjacent to the bending portions are respectively formed of at least two openings and two corresponding folding portions in order to allow the user to push and bend the plurality of folding portions toward the outer surfaces of the plurality of supporting members to reach the inner surface of the plurality of supporting members; thereby they are secured onto the plurality of supporting members. In addition, the plurality of openings can also be used as an auxiliary means for lifting and carrying the carton structure. As a result, the present invention indeed provides a carton structure that is of great convenience and high durability for use.

SUMMARY OF THE INVENTION

An objective of the present invention is to provide a carton structure, having strengthened connections among the four side wall portions of the carton structure, thereby the occurrence of indentations due to collisions at the four edge corners of the carton structure can be advantageously prevented.

Another objective of the present invention is to provide a carton structure, capable of allowing the user to vertically lift the carton structure for transportations while, at the same time, the usage durability of the carton structure is further enhanced.

To achieve the aforementioned objectives and others, the present invention provides a carton structure, comprising: a confined body portion having four side wall portions formed by using four boards of rectangular shapes, and bending portions formed between the plurality of side wall portions at an internal side thereof; a top cover arranged at a top of the confined body portion and configured to match with the confined body portion; a bottom cover arranged at a bottom of the confined body portion and configured to match with the confined body portion; and at least two supporting members arranged to attach onto surfaces of the plurality of bending portions respectively; wherein two upper and lower areas at outer surfaces of the plurality of side wall portions adjacent to the plurality of bending portions are respectively formed of at least two openings and two folding portions corresponding thereto; the plurality of openings and the plurality of folding portions are connected to each other along a base portion; and the plurality of folding portions are configured to be pushed and bent toward an outer surface of the plurality of supporting members in order to reach an inner surface of the plurality of supporting members such that the plurality of folding portions are secured onto the plurality of supporting members.

In comparison to the prior arts, the carton structure of the present invention has the following merits and advantageous effects: 1. Unlike the known carton structure, the present invention includes a plurality of supporting members arranged to attach onto the bending portions between any two adjacent side wall portions of the four side wall portions respectively such that the connection strength among the four side wall portions of the carton structure is increased in order to prevent the occurrence of indentations due to collisions on the carton structure; 2. the two upper and lower areas at the outer surfaces of each side wall portion adjacent to the bending portions are formed of at least two openings and two folding portions corresponding thereto in addition to that the folding portions can be pushed and bent toward the outer surfaces of the supporting members in order to reach the inner surfaces of the supporting members such that the folding portions are secured onto the supporting members; therefore, the present invention not only allows the user to utilize the openings provided for carrying and transportations but also allows the strength among the side wall portions of the carton structures to be further enhanced.

DESCRIPTION OF EMBODIMENTS OF THE INVENTION

To understand the objectives, features and effects of the present invention, the following detailed description of the embodiment of the present invention is provided along with the accompanied drawings to further describe the present invention in greater detail as follows.

Figure 1:
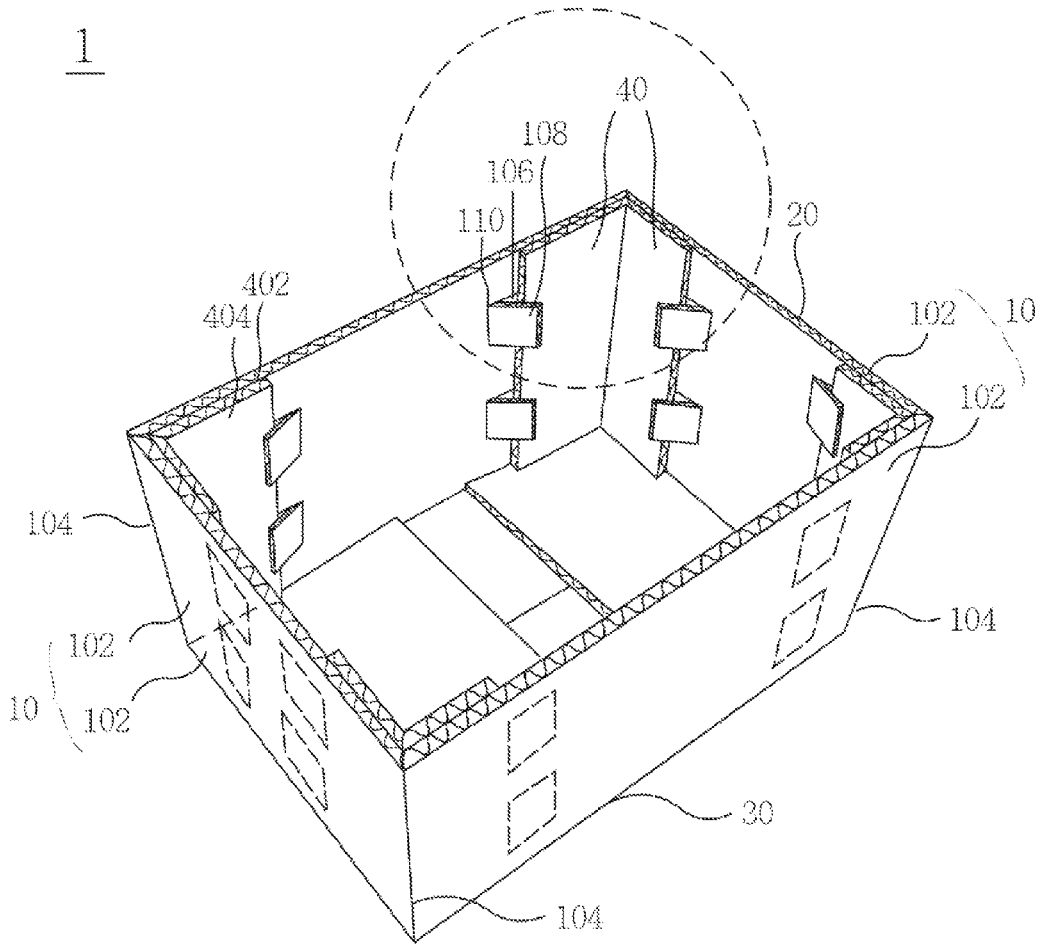
FIG. 1 is a perspective view of a carton box structure of the present invention.

Please refer to FIG. 1, showing a perspective view of a carton structure of the present invention. The carton structure 1 comprises a confined body portion 10, a top cover 20, a bottom cover 30 and at least two supporting members 40.

The confined body portion 10 includes four side wall portions 102 formed by using four boards of rectangular shapes, and bending portions 104 are formed between the plurality of side wall portions 102 at an internal side thereof.

The top cover 20 is arranged at a top of the confined body portion 10 and is configured to match with the confined body portion 10.

The bottom cover 30 is arranged at a bottom of the confined body portion 10 and configured to match with the confined body portion 10.

The plurality of supporting members 40 are arranged to attach onto surfaces of the plurality of bending portions 104 respectively. With the design of the supporting members 40, such design is able to not only strengthen the connection strength among the side wall portions 102 but also to prevent the occurrence of indentations due to the collisions at the four edge corners of the carton structure 1. Particularly, it shall be noted that the material of the carton structure 1 can be any one of a corrugated paper material, a plastic material and a wooden material; and the corrugated paper material can be further treated with a glazing oil coating or a wax coating in order to have the function of being water-proof. Furthermore, the confined body portion 10, the top cover 20 and the bottom cover 30 can be integrally formed as one single piece.

Figure 2:
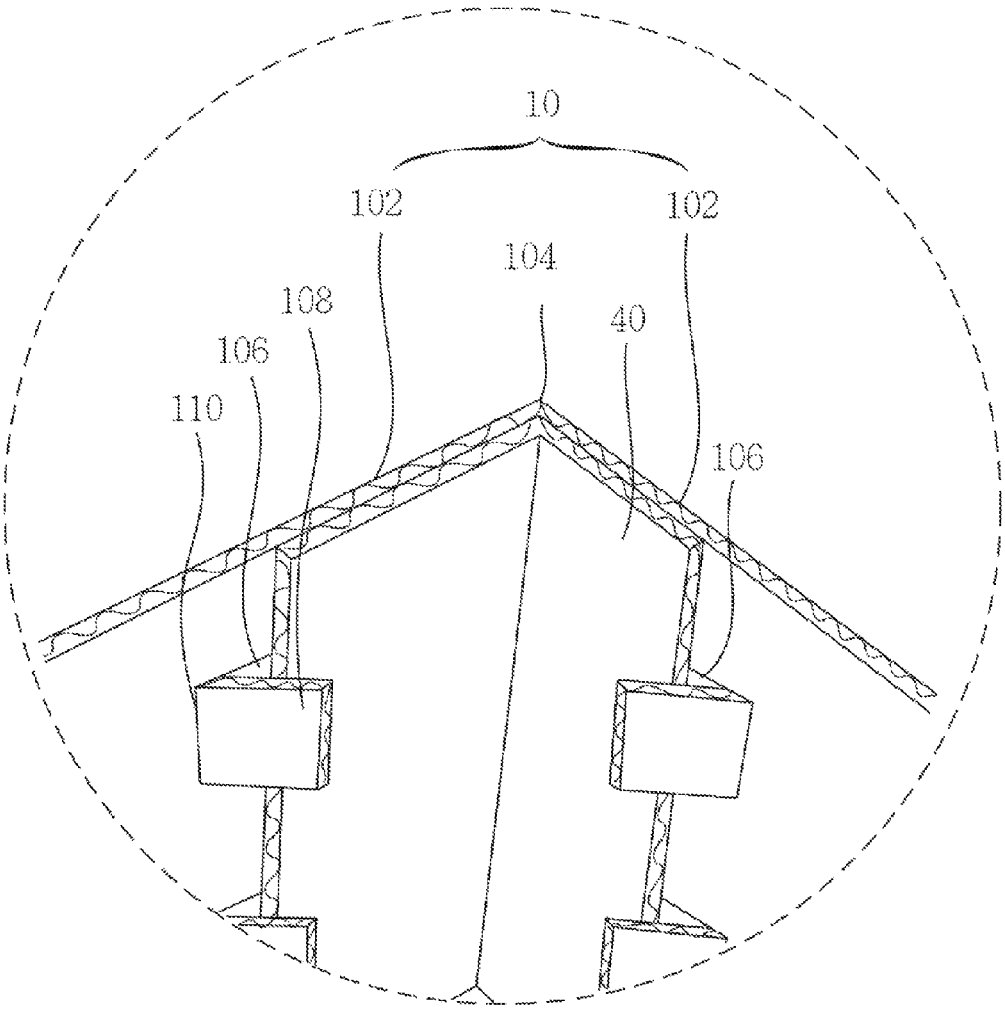
FIG. 2 is a partially enlarged perspective view of the carton box of the present invention in FIG. 1.

Please refer to FIG. 2, showing a partially enlarged perspective view of the carton structure of the present invention in FIG. 1. The present invention is mainly characterized by the following technical features: two upper and lower areas at outer surfaces of the plurality of side wall portions 102 adjacent to the plurality of bending portions 104 are respectively formed of at least two openings 106 and two folding portions 108 corresponding thereto; the plurality of openings 106 and the plurality of folding portions 108 are connected to each other along a base portion 110; and the plurality of folding portions 108 are configured to be pushed and bent toward an outer surface 402 of the plurality of supporting members 40 in order to reach an inner surface 404 of the plurality of supporting members 40 such that the plurality of folding portions 108 are secured onto the plurality of supporting members 40. In addition, it shall be noted that the base portion 110 is located at surfaces of the plurality of side wall portions 102; and a contour of each one of the plurality of openings 106 completely matches with a contour of each one of the plurality of folding portions 108; furthermore, the contour of each one of the plurality of openings 106 is of any one of a square shape, a triangle shape, a circular shape and an irregular shape; moreover, the plurality of folding portions 108 are secured onto the plurality of supporting members 40 via a connection method of nailing, press-fitting, adhering, locking pin or Velcro tape.

For using the carton structure 1, a user may first use his or her hands to pierce through, such as penetrating through or punching through, the openings 106 predefined and formed at the two upper and lower areas of the outer surfaces of the side wall portions 102 adjacent to the bending portions 104, following which he or she may then push and bend the folding portions 108 toward the outer surface 402 of the supporting members 40 along the base portion 110 in order to reach the inner surface 404 of the supporting members 40 in order to further secure the folding portions 108 onto the supporting members 40 via the connection method of any one of nailing, press-fitting, adhering, locking pin and Velcro tape. As a result, the carton structure 1 of the present invention is able to not only allow the user to vertically lift it up for carrying and transportation but also further strengthen the durability of the use of the carton structure 1 of the present invention.

The abovementioned embodiments are provided to illustrate the principles and exemplary methods of manufacturing or formation method of the present invention only. The scope of the present invention shall be defined by the claims recited hereafter, and any modifications or variations to the terms or wordings recited in the claims shall be considered as their relevant equivalence and are within the scope of the present invention. The scope of the present invention shall be determined by the content of the claims recited hereafter.

What is claimed is:

1. A carton structure, comprising:

a confined body portion having four side wall portions formed by using four boards of rectangular shapes, and bending portions formed between the plurality of side wall portions at an internal side thereof;

a top cover arranged at a top of the confined body portion and configured to match with the confined body portion;

a bottom cover arranged at a bottom of the confined body portion and configured to match with the confined body portion; and at least two supporting members arranged to attach onto surfaces of the plurality of bending portions respectively;

wherein two upper and lower areas at outer surfaces of the plurality of side wall portions adjacent to the plurality of bending portions are respectively formed of at least two openings and two folding portions corresponding thereto; the plurality of openings and the plurality of folding portions are connected to each other along a base portion; and the plurality of folding portions are configured to be pushed and bent toward an outer surface of the plurality of supporting members in order to reach an inner surface of the plurality of supporting members such that the plurality of folding portions are secured onto the plurality of supporting members; and wherein at least a portion of the folding portion is formed integrally with the side wall portion.

2. The carton structure according to claim 1, wherein a material of the carton structure is selected from any one of a corrugated paper material, a plastic material and a wooden material.

3. The carton structure according to claim 2, wherein the corrugated paper material is further treated with a glazing oil coating or a wax coating in order to have a water-proof function.

4. The carton structure according to claim 1, wherein the confined body portion, the top cover and the bottom cover are integrally formed as one single piece.

5. The carton structure according to claim 1, wherein the base portion is located at surfaces of the plurality of side wall portions.

6. The carton structure according to claim 1, wherein a contour of each one of the plurality of openings completely matches with a contour of each one of the plurality of folding portions.

7. The carton structure according to claim 6, wherein the contour of each one of the plurality of openings is of any one of a square shape, a triangle shape, a circular shape and an irregular shape.

8. The carton structure according to claim 1, wherein the plurality of folding portions are secured onto the plurality of supporting members via a connection method of any one of nailing, press-fitting, adhering, locking pin and Velcro tape.

* * * * *